US005105905A

United States Patent [19]

Rice

[11] Patent Number: 5,105,905

[45] Date of Patent: Apr. 21, 1992

[54] CO-LINEAR LOUDSPEAKER SYSTEM

[76] Inventor: Winston C. Rice, Box 618, Broadus, Mont. 59317

[21] Appl. No.: 519,478

[22] Filed: May 7, 1990

[51] Int. Cl.[5] ..... H05K 5/00

[52] U.S. Cl. ..... 181/155; 181/156; 381/160

[58] Field of Search ..... 181/153-156, 181/299, 144, 145; 381/90, 160

[56] References Cited

U.S. PATENT DOCUMENTS

| | | | |
|---|---|---|---|
| 3,590,941 | 7/1971 | McKenzie | 181/145 |
| 4,593,784 | 6/1986 | Flanders | 181/144 |
| 4,753,217 | 6/1988 | Flanders | 181/144 |

FOREIGN PATENT DOCUMENTS

| | | | |
|---|---|---|---|
| 20852 | 8/1956 | Fed. Rep. of Germany | 181/156 |
| 929705 | 1/1948 | France | 181/155 |
| 864683 | 4/1961 | United Kingdom | 181/155 |

*Primary Examiner*—Brian W. Brown

[57] ABSTRACT

A speaker housing arrangement which uniquely combines a number of acoustic functions is disclosed in both a simple embodiment and in a more complex embodiment. Each embodiment utilizes a pair of angular deflectors in a tubular or pipe type enclosure to directionally co-align the sound product from both sides of the speaker cone. A slight interval in time of egress between the pressure opposite signals provides sonic contrast and hence sharp imaging. In the simpler embodiment linearity and signal integrity is preserved throughout the sound spectrum. In the more complex embodiment part of the bass signal is momentarily retained for purposes of co-phasing in a partial bass reflex arrangement. Either embodiment permits the production of sound of unusual quality and quantity in relation to input energy and to cost and grade of components. Secondary improvements in high frequency linearity and in overall spectral equalization in the region of the speaker itself are also disclosed.

1 Claim, 3 Drawing Sheets

FIG. 4A
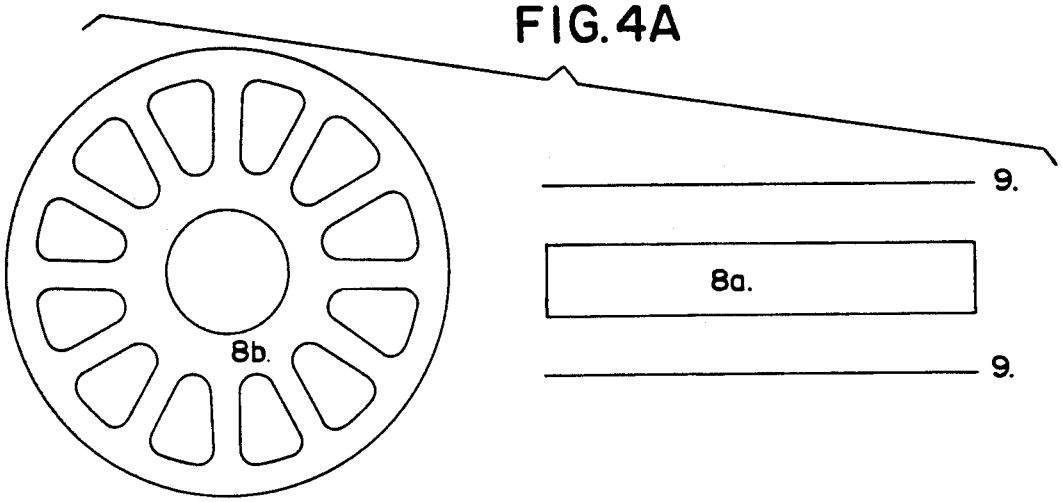
FIG. 4B
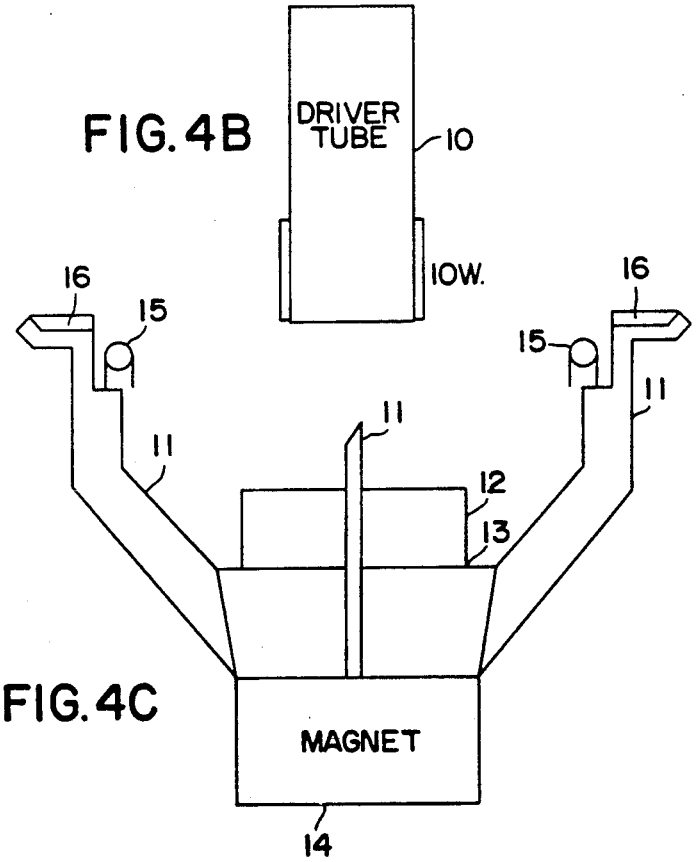
FIG. 4C

CO-LINEAR LOUDSPEAKER SYSTEM

FIELD OF THE INVENTION

The present invention pertains generally to the field of audio and more specifically to tower type speaker systems and speaker combinations intended to more fully and cleanly direct the audio energy toward the listening area.

PRIOR ART

If the distinction between acoustics and audio is that the former deals chiefly with naturally propagated sound while the latter usually deals with artificially reproduced sound then the former must go back into antiquity. For instance it appears that the designers of the medieval cathedrals understood, whether instinctively or explicitly, the importance of geometric linearity and the need for clean frontal wave propagating pathways free from spurious and disruptive reflective surfaces.

If audio began with the first mechanical-acoustic phonographs it did not take long thereafter to become an art. Considering the small energy source in the spring driven motor and the friction coupled transduction method used for providing diaphragm energy those early phonographs were remarkably efficient and were capable, with the right conditions, of producing sound that was surprisingly natural and pleasurable. While the energy from the backside of the diaphragm was delivered through an exponentially flared horn to provide audible deep bass notes the frontside was serving a tweeter function of sorts. Attention was given to utilizing the rather limited energy as fully as possible. Consequently the signal from both sides was directed toward the listener and none of it was permitted to bounce wastefully and detrimentally around the room until it had passed first through the listening field.

However, with the advent of electrical amplification and the sheer power that it could supply, many of the finer points of the art came to be overlooked and forgotten as quality was often subverted for quantity even though many improvements have been made over intervening time. Inumerable equipment designs have been advanced and changes made, all producing some net gain, still some of the finer sonic art of earlier times has not even yet made the transition into the field of electrical reproduction and amplification.

Since the introduction of the electro-magnetic speaker two problems have, to some greater or lesser extent, prevailed against a continuing series of proposed solutions. One of these problems has been in the handling of the backwave. The other has been the difficulty in deriving optimum, full spectrum sound from a single speaker unit.

Regarding the backwave, since it is half the output energy of the speaker unit and since it is the pressure opposite of the front wave the two are mutually cancellable if allowed to meet in place and time. Furthermore, the magnitude of the problem increases as power or amplitude is increased. Alternately, the backwave has been emitted from the back of the cabinet as, for example, in the early radio consoles, dashed against walls and into corners, both within and without its cabinet, to result in conflicting reflections and interference waves.

It has been contained and restrained within the speaker box, often a small one at that, so as to pneumaticly affect cone motion and thus compromise the frontwave product. 'Gray Noise', the transmittal through the cone itself of some of the chaotic energy generated inside boxes of rectangular construction, may affect frontwave quality in spite of the use of damping materials.

Thus, of the several genre of speaker systems existing only three may be identified which do not treat the backwave as a nuisance, a nuisance to either be supressed as much as possible or else ignored. The first of these three, the exponential horn, may do an admirable job of low end loading and delivery with its energy efficiencies extending well up into the middle frequencies but at the same time, as a backwave propagator requiring directional change, its geometry cannot provide parallel linearity necessary to produce mid to higher frequencies without 'smearing' or distortion of the signal. The horn is also impractically large in its more effective forms.

The second of the aforementioned three, the reflex baffle, is usually a rectangular box and is therefor subject, in some degree, to the rectangular box internal problems previously mentioned. It stifles most of the backwave sound down through all but the low end of the spectrum but does provide to salvage an usually narrow band from the lower frequencies. This is accomplished by the use of a formula involving the relationship between speaker size, box volume and porting dimensions to produce a cavitational resonance which essentially results in 'co-phasing', the matching in time of the previous backwave with the present frontwave or forepulse so that they occur together as a single strong pulse. Reflex boxes must also be large for good results.

Although the reflex box does achieve a strong bass it loses other values in doing so. For one thing, the bass backwave notes are stripped of both their natural overtones and their frontal wave attack characteristics so that they tend to come through 'throbby' and 'boomy'. For another, the resonant frequency may not remain stable since the system is tuned according to a certain set of criteria which overlooks one function which is a variable, that of playing amplitude. Increasing the power setting has, by surface versus stroke equations, the same effect as increasing speaker size and may, therefor, upset the critical predetermined tuning of the system.

The third genre of systems in which consious use, rather than waste, is made of backwave energy are those systems which are usually described as "open ended", "pipe" or tubular systems and which can usually be divided into two general types which still share one very important feature. By confining the backwave within a defined channel for some distance certain inertial loading effects are brought to bear upon the speaker so that its low frequency capabilities may be lowered by as much as an additional octave. (Refer U.S. Pat. No. 3,523,589, J. J. Virva) Such effects could probably be described as "channel loading".

One of the two types in the third genre of speaker systems as just discussed is usually known as the labyrinth or transmission line system. In their several variations they employ baffling and/or damping material in the backwave channel to control detractive resonance and, perhaps more importantly, to delay the wave sufficiently to achieve some measure of bass range co-phasing which usually occurs across a wider band of the low frequency spectrum than that provided by the bass reflex systems. These backchannel systems however, because of the routing, baffling and damping lose all semblance of linearity in the backwave path so that most or all upper spectrum backwave product is lost as it is, likewise, in the bass reflex and most other systems. Additionally, were the signal pattern to survive in good form, in most cases it would be directed away from the listener into some uncontrolled situation so that its value would be lost.

The other of the two backchannel types is simply a pipe or tube with a speaker mounted across one end and usually set in a vertical position. Its greatest virture is its extreme efficiency since it is linearly open and clean. It, in any appreciable length of tube, also possesses the ability to lower effective minimum frequency below that of the speakers natural resonance. The bass product, although clean and rich with bass note harmonics, is only moderately strong since the system is not capable of co-phasing unless built extremely tall. When in a favorable setting and attitude permitting it to be heard cleanly it can produce a tandem contrasted sound of sharp image if the signals from its two ends are heard in proper balance. Its greatest drawback, however, is bad reflections. Since it directs its energy against the ceilings and floors of the room most of the sound results from a series of room reflections rather than directly. In creating sound with a large jumbled component, this example amply demonstrates that fidelity, the precise imaging of sound, is best obtained by attention to the most direct and linear routing of the signal from the source to the listener.

Alternate forms are built with dispersion panels resulting in annular ring porting, top or bottom or both to project full circle sound but which results in reflections coming from all directions. Again the need for care and control in directing or reflecting sound energy is exemplified. For instance, a smooth surface set at an angle of forty-five degrees in an axial output from a loudspeaker has the capacity to redirect the product at ninety degrees from the original axis without upsetting the lineaer integrity and hence the signal pattern of same. The use of deflecting surfaces in sound delivery techniques has long been known. For example, mechanical-acoustic phonographs often had lids which could be canted at a reflecting angle. The deflector has been used as a component of sound delivery systems in more recent art yet some possibilities for, perhaps, its more effective usage applications have remained undisclosed.

The second of the two long persisting problems earlier mentioned has to do with the abillity of a single speaker unit to faithfully reproduce full spectrum sound. While some single element speakers are sold as 'full range' speakers the dictum that "no one speaker can amply produce full range sound" is the generally accepted opinion. Aside from efficiencies of the electromagnetic driving motor and other construction considerations, broad range fidelity, particularly the high end function, is mostly determined by two constraints. One is mass-to-energy ratio and the other is the actual shape or contour of the propagating element or membrane itself. Many of the high frequency limitations which have been blamed on the former have really been due, instead, to the physical aspects of the latter. And while so-called 'planar' speakers have been manufactured and which produce excellent broad range sound the technical logic behind their fidelity has, perhaps, not been sufficiently defined and so will be addressed here. Traditionally propagating elements have been either cone or dome shaped because of the inherent rigidity and strength in these shapes, shapes which yield the important high strength-to-mass ratios needed. These same shapes, however, tend to compromise the performance of the speaker and to place limitations upon high end capabilities.

Since sound waves in the range of fifteen thousand cycles per second measure, wavefront to wavefront, only about three quarters of an inch, a difference of only three eighths of an inch creates a half lap condition. Even if high frequency waves arising from two separate points, one such point being a half wave more distant than the other, do not cancel in the immediate vicinity of the speaker they must, in converging enroute to the ear of the listener, effect some form and degree of cancellation upon each other and thereby compromise the accuracy of the original wavefront. Therefor a surface deviation of even a quarter of an inch is significant at frequencies above fifteen thousand Htz and many tweeters, not to mention so-called full range speakers, exhibit concave or domed surfaces of greater difference.

By the same token, a frequency of one thousand Htz has a wavelength in the neighborhood of ten inches, half of which is little more than the depth or concavity of many fifteen inch speakers. Thus, it is evident that even in the mid-ranges a very deeply coned speaker cannot present a unified wavefront, i.e., parallel linearity, that although at lower frequencies the air itself has some natural tendency to unify wavefronts, still the potential for sharply demarcated wavefronts is lost and that in no case can sharply demarcated wavefronts be produced from highly irregular surfaces. Although it may be argued in some quarters that the interior surfaces of a cone describe lines which converge as a point source some distance ahead of the cone the motion of the cone is not perpendicular to those surfaces so that argument is largely negated. So while conventional shapes are justified largely on grounds of structural rigidity it would seem that flat plane surfaces are required for maximum clarity.

One more aspect of cone shape needs to be discussed. In prior art any utilization of backwave energy has only been low end utilization. Consequently, no attention at all was given to fidelity in the mid and upper range of the backwave product. Accordingly, not only has it not been seen as any problem that the rear side of the cone, with its convex surfaces, also offers poor linear characteristics but, additionally, that nearly half the propagating surfaces in many speakers is covered by the supporting frame of the unit. In most cases the supporting metal is in the form of wide spokes so that the air which is trapped between the membrane and the spokes is forced to move laterally and then to collide head-on with air likewise being forced out from under an adjacent spoke. It is, of course, not possible to derive a signal with any degree of equi-linear integrity from these conditions and opportunities for obtaining sonic contrast in the upper registers of the backwave product, the "icing on the cake", are lost.

Attention, in an analysis of prior art relative to the present invention, needs to brought to bear upon the topic of 'phasing' and the well known problem of cancellation. In audio a sonic cycle might be defined as "the period during which a volume of air is caused, by some physical means, to move as a wave of compression or positive pressure which is followed by an opposite or compensating wave of rarification or negative pressure. Of course it follows then that the air medium on either side of the 'physical means', the speaker diaphragm in audio, will adopt opposite pressure conditions as the diaphragm moves suddenly back and forth. A sonic cycle, therefor, is a situation of opposites in space on the one hand and of opposites in time on the other. And a 'phase', then, might quite properly be described as either half of a full sonic cycle whether we speak of it in either a particular place or in a particular time. Some speaker equipment, for example, has been described, rather inaccurately, as "phase inverting", even insofar as that bouncing a wave off an angular surface inverts it. In reality, the bouncing of a wave off an angular surface can only effect a mirror inversion, top for bottom, etc., hardly meaningful in audio, but cannot effect a true pressure inversion. Most other such equipment could much more accurately be described as "synchronizing" or, better yet, as "co-phasing" instead of "phase inverting" since the function is not to effect inversion but to effect a time delay in the backwave so that it is released, ideally, into the listening field coincidental in both time and pressure mode with the frontal wave. Such delay may be accomplished by cavitational reflex, by circuitous or para-obstructive routing or other means. Accordingly, the more accurate term "co-phase" will be used herein.

OBJECTS OF THE INVENTION

It shall be an object of the invention to cause a loudspeaker to be heard nearly as if both sides faced forward but with one side slightly more distant. It shall be an object of the invention to cause the rear of the speaker to be heard as a pressure opposite signal just slightly later than the frontal signal thereby providing sonic contrast. It shall be an object of the invention to provide for a bass resonance below that of the speakers 'open air' resonance. It shall be an object of the invention to furnish a speaker housing with two ports which face in the same direction but with substantial distance between. It shall be an object of the invention to strive for maximal linear integrity in delivery of sound energy from both sides of the transductance medium. It shall be an object of the invention to accomplish all foregoing by means of a loudspeaker mounted within a tubular structure whose inner axis is turned at each end to near ninety degrees by means of angular deflecting panels. It shall be an object of the invention to include all of the foregoing in a single embodiment. It shall be an object to provide a second embodiment of the invention which shall include the first embodiment albeit in somewhat changed proportions and which shall further include additional structure so as to provide some degree of bass reflex capacity.

SUMMARY OF THE INVENTION

In order to more clearly 'define the reason for' at the same time that each 'how made' step is explained in this summary of the invention this summary will explain the invention as a 'developing embodiment' evolving out of prior art, which, in reality, it is.

In the first and simpler of the two preferred embodiments of the invention a speaker is mounted transversely within a tubular housing. To avert the problem of bad reflections and cluttered response common to open pipe type enclosures when situated in the usual space saving vertical position, the two ends of the tube are closed off and replaced by a pair of ports, one in each end of the tube and both facing in the same direction. The area of each of the ports is generally equivilant to the area of the tube end that has been closed off. The device, at this point, has been converted from omni-directional to uni-directional and a greater portion of the sound energy will be directed to the listener in a more controlled fashion instead of bouncing between floor and ceiling as spurious sound. However, two rather serious problems remain, namely; cancellation and poor linearity.

If the speaker unit is situated at the midpoint within the tube it can be seen that, it being equidistant from either port, the response will issue from each port at the same time but opposite in pressure. Each motion of the diaphragm will result in a pressure 'plus' on one side and a pressure 'minus' on the other creating waves which will reach the two ports in unison and will result in a great deal of cancellation, much in the bass frequencies nearby as well as some in the higher frequencies as the propagational lines from the two ports converge on their way toward the listener. So, although the midpoint siting affords near perfect cone loading, it will be necessary to shift the speaker off the centerpoint within the tube to cause the signal to emerge from one port ahead of the other.

Shifting the speaker toward one end, of course, increases the distance to the other end at the same time so that twice the effective distance is placed between the emerging signals. A shift of six inches, for example, effects a difference of twelve inches between the two signals reaching a listener some distance away. Using a shift of seven feet, although impractical for several reasons, would provide an arrival interval of some fourteen feet or the half wave of extremely low bass at around thirty Htz thus affording perfect co-phasing at that spectral point. Too great an interval between signals, however, creates a higher frequency problem in that the sound seems to be coming from two different sources. Distance of shift as well as the long dimension of the housing itself must fall between two constraints. On the one hand, increasing the interval improves bass response, on the other, the double source problem and the impractical size argue for shorter dimensions. Also, on one hand, while bass response may suffer from shortening the interval, for the reasons just cited, on the other hand bass response is favored by the extreme efficiency and excellent loading characteristics of the design. Additionally, a separation at the points of interface with the air medium are at least as great as the same separation in a bass drum, for example.

The second problem to be dealt with is the problem of geometric linearity or lack thereof. Proceeding in one or the other directions from the speaker the propagational lines are parallel and, idealisticly at least, of equal length. Upon squarely striking the end closures and being diverted at right angles through the ports the propagational lines reach the open air with disimilar lengths in the same manner in which the outer wheels of a vehicle must travel farther around a curve than do the inner ones. The speaker is thus heard obliquely, a 'smeared' signal with distorted high frequency response.

One more problem, not mentioned previously, also needs to be discussed, the problem of cavitational resonance, the tendency of an enclosed volume of air and due to its elasticity, to spring back and forth upon being disturbed. The period or duration of the oscillations is controlled by the size and also, but to a lesser extent, by the shape of the enclosed volume. When the disturbance is being produced by a loudspeaker and when its output frequency matches that of the oscillatory period or 'natural resonance' of the cavity a buildup quickly occurs so that one particular frequency stands out as strongly resonant. And since musical format consists of a broad range of frequencies the resonant frequency soon becomes an undesireable dominant sound.

The solution to the linearity problem defined previously and the resonance problem just discussed, have, fortunately, a single solution and one which also completes the basic configuration for the simpler of the two embodiments of the invention. Required is the placement of a pair of deflecting panels, set at forty-five degrees to the tubular axis, one behind each port. Fully occupying the cross-section of the tube behind the port and with a smooth surface, the deflectors permit the redirection of the signal without any appreciable pattern disruption since the propagational lines merely cross through each other without undue interference. When both the forewave and the backwave are channeled in this way the net effect is as if both sides of the speaker were facing the listener at the same time, one slightly more distant than the other.

Meanwhile the deflectors have solved the resonance problem as well. Since the original cavity enclosed by the tubular housing is divided by the speaker and its mounting panel into two smaller cavities, one being quite short because of the speaker being shifted toward that end, the other being longer and capable of absorbing more oscillatory energy, only the longer one is of any significance. But, with the deflector panel now in place, the resonance wavefront obliquely strikes the panel so there is no rebound. At the same time energy is emitted from the port. In this way deflector and port together act as an anti-resonance valve and unwanted resonance becomes of no significance.

Having, at this point, described the whole embodiment of the speaker enclosing structure in its simpler form so that a more or less complete if generalized mental picture may be composed it is now necessary, in defining scale and other construction detail, to return to the earlier discussion of shift distance within the tube and overall dimensions. Because the scale of the structure is keyed quite closely to the size or diameter of the speaker and because different sized speakers may be used thereby calling for the building of different sized enclosures the diameter of the speaker or the consequent width of the tube will be used as the basic unit of measurement.

While there are some volumetric differences in whether the tube is either round or rectangular and these differences will, of course, engender some difference in response the important ratios remain mostly unchanged and so the differences are not deemed to be great enough to warrent a change in specifications from square to round etc. The specifications may be used interchangebly. Construction materials are quite optional provided they are sufficiently rigid or heavy that they do not absorb sonic energy unduly and surfaces, especially in the case of the deflectors, should be reasonably smooth. Accordingly, various plastic products, sheet woods, masonites etc. may be used if meeting above and other construction requirements.

It is apparent that the deflectors themselves must occupy a certain distance within the tube. Because the deflectors are placed at an angle of forty-five degrees the distance from a central point on the deflector to the adjacent end closure plate or plug is just one half tube width therefor the two deflectors, taken together, occupy one tube width within the length of the tube. The next consideration is the shorter cavity between speaker and deflector. It is, of course, structurely possible to eliminate this cavity altogether by mounting the speaker within one of the ports and then to double deflect the backwave to achieve directional unity. While such a move offers some attractions it would result in sacrifice of much of the quality afforded by the present configuration. The distance from the speaker to the near edge of the deflector should be one half tube width.

Since good bass response requires a minimum interval of at least eighteen inches and high end response, for the sake of singular imaging, prohibits an interval of more than about twenty-six inches an 'off the mid-point shift' of half that distance or from nine to thirteen inches is indicated for speaker location. Therefor the distance components are as follows; first deflector, one width; edge of first deflector to speaker, one half width; distance from speaker to center point on the second deflector of from eighteen to twenty-six inches plus one half width to account for the distance from the centerpoint of the second deflector to end gives the whole length of the tube. It now becomes obvious that the use of larger speakers dictates a considerable height in the standing unit, forty to forty-eight inches, for example, with an eight inch speaker.

The requirements for structural height as just outlined draw the attention to small but powerful speakers, such as are used in sealed systems, as an option permitting reduced tube size and overall size as well. While these speakers can sound and serve quite well while saving much in bulk and space they may also present some problems at high playing amplitudes. These problems have to do with the reduced volume of air contained within the smaller enclosure which, at high amplitudes, is required to move at higher velocities over greater distances which somewhat reduces the interval between signals and may induce a noticeable degree of Doppler distortion wherein the short range motions of the highs, being immersed in the long range motions of the lows, are alternately crowded together and then stretched apart so that their frequency falls above and below the true signal frequency. So while these small but powerful systems may have their place when not driven excessively the better choice, when space is not an important criteria, is for specifications which permit a larger diaphragm to engage a larger volume of enclosed air at lower energy levels which yields a sound product which is very natural, rich and clean.

The embodiment as outlined so far offers a unique approach to enjoyable musical reproduction. By saving the backwave in as intact form as possible and by directing it into the listening field its upper to low-mid frequencies serve to both fortify and contrast those same frequencies in the front wave signal. With a slight timing interval between the two signals they are heard as a single signal of exceptional clarity and presence. In audio, as in optics, contrast is conductive to sharp imagery and distinction. Bass output, however, although exceptionly clear, is only moderately strong when heard against a backdrop of full energy mid-range. It does not stand out at flat power settings as does the bass signal in the bass reflex system but when given the benefit bass boost EQ power settings the sound becomes spectacular with clean power but with no trace of the 'sogginess' so often associated with bass reflex systems.

However, due to varied listener preferences and due to the fact that a great part of existing playing equipment such as small home players, television sets and portable players have no special EQ or bass boost power provisions there is an ever present demand for speakers with emphasised low end product. Bass emphasis within the speaker system itself can only be accomplished by some measures which effect a time delay in the backwave sufficient to introduce some degree of co-phasing. In order to achieve extra bass emphasis the co-linear embodiment so far outlined is provided with some bass reflex capability to become a second embodiment which could be called a para-reflex. While giving up but little in clarity it gains substantially in bass response.

This second embodiment, a modification of the simpler embodiment of the speaker housing arrangement heretofore described, retains the basic arrangement of that housing, although with some dimensional changes, but adds the feature of a bass reflex chamber. The outer housing shell remains the same. The short cavity with its port and deflector remain the same. The changes are all inside the longer cavity which is now divided into two elongated chambers, one of which surrounds the other. A tapered tube, whose larger end is of the same cross-section as the diaphragm, is attached to the speaker in an airtight manner. The smaller end of this tube has a cross-section area of at least forty percent but no more than fifty percent of the area of its larger end. After the determination of area for the small end has been made it, the small end of the tube, may be cut to a forty-five degree angle to subdue resonance. The associated deflector and port are also reduced in size to the size of the small end of the tube. Reducing the size of this port opening performs a part of the bass reflex function by, one; slowing the egress of the volumeous bass wave and, two; retaining a portion of the bass wave to reflex within the surrounding outer chamber.

The true area of the small end of the tapered internal tube, before any diagonal scribing is done, is rather critical since its size is also the size of the associated port and is a determinent in the size of the associated deflector, which, at forty-five degrees to the axis of both the tube and port, is fixed centrally upon the floor or bottom with open space between it and the walls of the outer shell on all sides. The original diameter of the small end of the internal tube is also the determinent for the distance between its own longer edge, after the cut has been made, and the centerpoint of the deflector which distance should be one and one half times that diameter. Figuring, inversely perhaps, the forty to fifty percent of speaker area for port size first, either as a rectangle or a circle as consistant with the structure, then figuring port diameter and then subtracting one and one half times that diameter from the distance between speaker and floor gives the length to be used for the tapered tube. It may also be noted that the diagonal cut to be made on the smaller end must match the angle of the installed deflector as it faces the port.

Including the detaining function of the reduced port size already mentioned, this arrangement of tube end, air gap, deflector and port now serve to function as an acoustic filter passing those frequencies from low-mid to upper range directly through the port because of their more linear characteristics. Meanwhile, most of the more volumeous bass wave rebounds to travel up the outer chamber and then rebounds downward again to have traveled three lengths or laps by the time it returns to the region of the port where some of it escapes after having traveled some seven and a half feet (3×30") within narrow confines. This distance should yield a half wave and thereby co-phase in the range of about sixty-five Htz. However the remainder of the pressure wave bounds up and down once again to complete five laps or a distance of nearly thirteen feet to co-phase in the range of forty Htz. The wave is probably slowed somewhat by rebounding within the narrow confines so the bottom Htz. may be actually somewhat lower. Also, in actual practice, the rebounding within the narrow confines may serve to broaden and generalize co-phasing in the lower registers.

The last subject to be addressed in the summary of the invention is the speaker or transducing unit itself. Since either of the enclosures which have been outlined here are capable of delivering precise imaging which may be expressed as parallel propagational lines of equal length, i.e.; linear integrity, from either surface of the speaker, a speaker capable of precise linear charactaristics to match is required to fulfil the potentials of the system as a whole. Furthermore, there are constraints of availability in the present speaker market as well as necessary developmental time and costs which dictate meeting these requirements in first a minimal and later a maximal way. It is necessary to divide this subject into two parts; one dealing with the linear generating capabilities of the propagating element, the other with the reduction of obstructive and disruptive effects from the speakers supporting framework.

Conventional loudspeakers may be made more equilinear quite simply and easily by moving the 'source surface ' forward from the center of the cone so that the waves arising there are more concurrent with those arising from the rim regions. The center area of the cone, by virtue of being more closely linked with the driving elements, is naturally a more accurate propagating area for highs than are the outer regions. But since those outer regions are of considerably greater area something approaching a stand off occurs as to which area is of greater importance at a given point within the high frequency end of the spectrum. The only reason, however, that it matters at all is that the rim and center areas of the cone are 'out of sync' with each other as far as the highs are concerned. Some speakers attempt to overcome the problem with a 'whizzer cone' which is a secondary cone situated in the center of the main cone, attached at the apex and with unsupported edges. Serving as a secondary interface between the highly motile central region and the air medium, there is effected some improvement in the highs. More importantly, however, the whizzer cone can serve as the support structure for a plane surface disc to propagate high frequencies. The disc, cut from some material with a high rigidity to weight ratio such as sheet styrofoam, with an area on one side equal to thirty percent of the area of the main cone, is simply cemented to the whizzer cone to thereafter generate wave patterns more concurrent with those from the outer zones of the cone.

Alternately, where the speaker has no whizzer cone, a supporting column for the disc may be formed by cementing a strip of similar material into a cylinder which is, in turn, cemented to the center of the main cone to serve as a supporting pedestal for the disc. Although these fixtures do add minuscule weight with some consequent bit of damping effect, the gain realized far exceeds the loss. These simple measures can raise both the audible frequency ceiling and the audible highs to lows amplitude ratio. Although far short of the ideal of an entire propagating element of inflexible plane surfaces, both front and rear, which produces no propagational lines of dissimilar length, the measures just outlined still provide a substantial gain in the forewave product, if not the backwave.

More closely approaching the ideal propagating element by replacing the usual cone requires, in all but the smaller and lower powered speakers, more than a flat plate of some extremely light material. The chosen material and design must be sufficiently light yet very rigid so that the delicate highs are not absorbed but are transferred to the air medium as wholly as posible. On the other hand it must be able to endure the most powerful motion pulses that the driver windings can dish out without deformation. It must be able to handle all the frequencies in between as well and do all over time without fatigue or separation. It must be free from internal resonance. Needless to say, treated paper formed into a cone shape is ideally suited to these stresses but actually serves as a rather poor interface with the air medium.

Meeting these various criteria, as nearly as is possible with present day materials and subject to change as materials with greater strength to weight ratios become available, may be accomplished by a 'sandwich' design. A buttress spacer is cut from styrofoam in a wheel shape including rather slender rim, spokes and a rather large hub with a central hole of the proper size to accept a tubular element integral with the driver windings. Relative to power capacity anticipated but which should be expected to range from medium to high, rigidity should be achieved by increasing the depth or thickness of the spacer itself instead of thickening the rim and outer spoke sections although increasing the loading capacity calls for progressive widening of the inner radii of the spokes as well as greater circumference of the hub area. Using an eight inch speaker intended for medium to high power applications for an example, and scaling other sizes substantially accordingly, the thickness of the spacer should be in the range of fifteen to eighteen percent of overall diameter or about one and a quarter inches. The rim and outer radii of the spokes should be about three eighths wide with the spokes and intervening spaces twelve in number which gives a width of nearly two inches at the outer region of the spaces. The final step is to cement a disc cut from sheet styrene to either side of the wheel thereby forming the 'sandwich'. To keep the weight of the assembly minimal the styrene should be just thick enough that it does not readily deform where it bridges across the spaces between spokes. The discs, of course, have center cutouts as necessary to accomodate the driving tube. Alternately, depending upon other qualities and requirements, options such as changing to urethane foam or varying thicknesses, number of spokes etc. may become desireable.

The measures described furnish a propagating element with the ability to produce concurrent or equilinear sound energy over a wide frequency range with minimun distortion and from both surfaces, fore and aft. The surrounding interseal element between the propagator as just described and the outer frame rim should be of design and quality sufficient to allow maxim motion without undue resistance and still give some degree of lateral support regardless of position.

Lastly, improving backwave fidelity by providing more equal lines of transit between propagating surfaces and listening field, especially in the higher registers, requires some redesigning of the speaker unit frame, also called, alternately, the spider or the basket. The goal is, of course, to open up and clear the rear surfaces to permit the desired linearity and to do so without adversely affecting structural strength and stability. Ease of construction, production and consequent costs are, of course, always constraints to be reckened with. Machine stamped frames of a much more open configuration may be made without reducing overall strength by the device of bending the spokes of the frame into a U shaped cross-section and then pressing the top of the U closed so as to obtain a teardrop shaped cross-section. Alternately, a stronger frame of open configuration may be made by either casting aluminum or by fabricating the unit so that its spokes are of solid flat metal in an edge-on position in relation to the propagating surface. Accordingly, the rim structure and the central supporting structure are both constructed so as to present as little linear obstruction as is possible. The equilinearity offered by the propagator design is thus afforded passage and wave integrity compareable to that of the forewave thereby yielding a quality backwave product to be delivered co-linearly, as provided by the housing design, with the forewave into the listening field.

BRIEF DESCRIPTION OF DRAWINGS

FIGS. 4A–4C exploded and partly bisected view of loudspeaker with propagational element replacing conventional cone diaphragm and with clear passage frame structure. Speaker has capacity to generate linear sound charactaristics consistant with delivery capacities of housing arrangement.

DETAILED DESCRIPTION OF EMBODIMENTS

Figure 1:
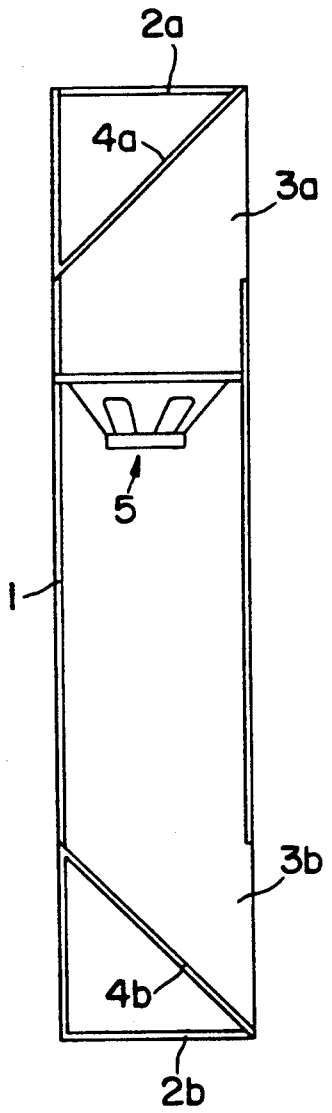
FIG. 1, bisectional view of simple embodiment of the invention showing tubular housing mounting loudspeaker, pair of deflecting panels and pair of unidirectional port openings.

Outer tubular shell or housing (1) may be either round or rectangular in cross section and of material which is substantially impermiable to sound vibrations. Tube end closures *2a*, *2b* are of likewise suitable material. Port openings *3a*, *3b* at either end of tube are of substantially the same area as the speaker to be used and face in the same direction. Deflector panels *4a*, *4b* at least equal in rigidity to outer shell, are mounted directly behind the port openings at an angle of substantially forty-five degrees to the long axis of the tube. The loudspeaker 5 is mounted transversely within the tube at a point one half its own diameter below the lower edge of the upper deflector. Height of the entire structure is dependent upon the next distance which is optional at between eighteen and twenty-six inches from the speaker position to the top edge of the lower deflector plus distance to be allowed for that deflector and lower end closure. Meanwhile interior diameter of the tube must be large enough to accomodate the chosen speaker. While some of the channel loading effect is lost in the FIG. 1 embodiment if that diameter is allowed to be greatly more than that of the speaker a somewhat greater diameter is permissible in the case of the FIG. 2 embodiment where a somewhat larger outer cavity is conductive to more bass reflex effect. In other considerations, minimizing the floor space required is usually found to be desireable.

Figure 2:
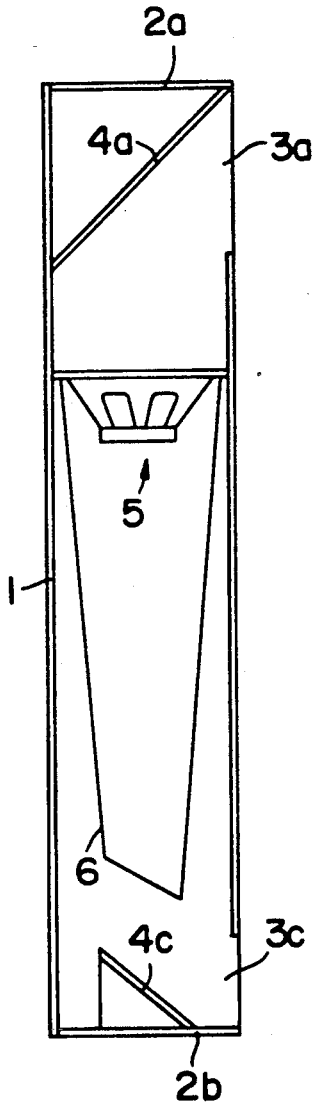
FIG. 2, bisectional view of para reflex embodiment showing top structure substantially the same as that in FIG. I but with bass retaining features in lower structure.

In the FIG. 2 embodiment a tapered tube is fitted to the under or backside of the speaker. Its diameter at the point of attachment corresponds to the diaphragm diameter while its smaller end is reduced to from forty to fifty percent of the area of the upper end. This tube 6 has, after the area determination has been made, its lower end beveled off at forty-five degrees. Size of the associated deflector as well as the associated port opening are downsized to the same area as the small end of the tube before the cut. After the overall or outside height of the structure has been determined as if a FIG. I housing were the goal the length of the interior tube 6 can be determined. The smaller deflector 4*c* is fixed centrally upon the floor behind the smaller port opening 3*c* at the required forty-five degree angle.

Using the diameter of the small end of the tube previous to making the cut, the distance from floor to tube end is one and one half times that diameter with the remaining distance to the speaker to be the length of the interior tube.

Figure 3:
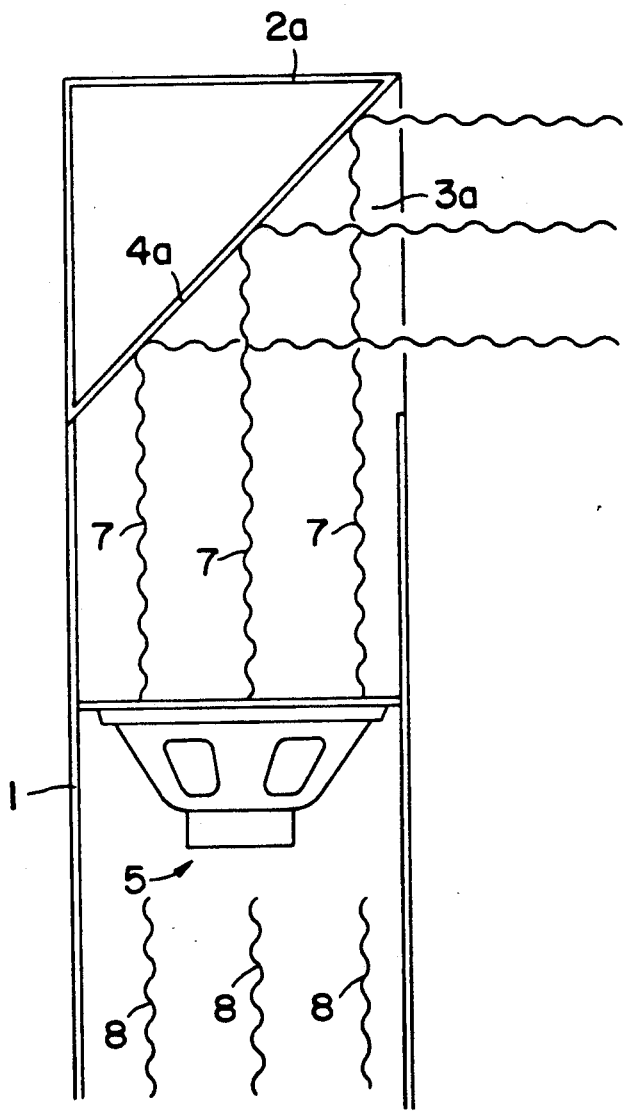
FIG. 3, graphicaly depicts capacity of angular deflector arrangement to preserve linear characteristics of sound energy while effecting directional changes.

In FIG. 3 the function of deflector 4*a* and 4*b* (not shown) in redirecting sound energy, depicted by wavey lines 7, 8, is shown. While a conventional speaker unit is shown in this representation it may be seen how a flat surfaced propagator type speaker, such as shown in FIGS. 4A–4C, can generate an energy signal whose propagational lines can be preserved in their original state of high distinction from both sides of the speaker throughout their delivery to the listening field.

In FIG. 4A the buttress spacer 8*a*, shown in edge-on position, forms the foundation component in the sandwich construction of the propagator element with styrene discs 9 laminated on either side. The spacer 8*b*, shown in face-on position, is cut or molded from styrofoam, ureathane foam or some similar light weight but high strength and rigid material. In FIG. 4B the driver tube 10 couples the voice coil winding 10*w* to the propagator by having its adjacent end inserted into the matching opening in the center of the propagator and secured with a suitable adhesive. In FIG. 4C the frame legs or spokes of the unit are either of molded or fabricated construction or are of stamped metal folded into a teardrop or closed-top U shape in cross section. In either case they are made as narrow as possible edge-on to the propagator in order to provide an open flow profile between the flat plane of the propagator and the deflector. By these measures is the backwave product made as clean and sharp as the forewave product. The legs are identified as 11.

The legs 11 are attached to the central structure 12, 13 of the of the unit as is the magnet 14. The propagator, constituted by 8*a*, 8*b*, 9 is coupled to rim flange 16 in a floating mode by surrounding flexure seal 15 to complete the unit.

I claim:

1. A co-linear loudspeaker system comprising:

a vertical tubular housing having a long and short axis and a top and bottom end, each of said top and bottom ends are closed by a respective top and bottom closure member;

a speaker having a front and back side, and a cross-sectional area;

a first port disposed in said vertical tubular housing adjacent said top closure member and facing a direction, said first port having a cross-sectional area substantially equal to said cross-sectional area of said speaker;

a second port disposed in said vertical tubular housing adjacent said bottom closure member and facing in said direction, said second port includes a cross-sectional area that is 40 to 50 percent smaller than said cross-sectional area of said first port;

a first deflector disposed and mounted in said vertical tubular housing behind said first port and between said speaker and said top closure member, said first deflector being oriented at an angle of substantially 45 degrees with respect to said long axis;

said speaker being disposed and mounted in said vertical tubular housing parallel to said short axis directly behind said first port with said front face facing said first deflector, said speaker includes an inner tube having a first end receiving said back of said speaker and extending a length of substantially three quarters of a length between said back of said speaker and said bottom closure member, said inner tube converging toward and terminating with a second end having a face angled at an angle of substantially 45 degrees with respect to said long axis, said second end of said inner tube being 40 to 50 percent smaller than said first end; and a second deflector disposed and mounted in said vertical tubular housing directly behind said second port between said bottom closure member and said second end of said inner tube, said second deflector being oriented at an angle of substantially 45 degrees with respect to said long axis, said second deflector being substantially 40 to 50 percent smaller in size than said first deflector.

* * * * *